US006390359B1

(12) United States Patent
Lin

(10) Patent No.: US 6,390,359 B1
(45) Date of Patent: May 21, 2002

(54) CORNER STRUCTURE OF ARTICLE-HOLDING BOX

(76) Inventor: Chien-Hung Lin, P.O. Box 453, Taichung (TW)

( * ) Notice: Subject to any disclaimer, the term of this patent is extended or adjusted under 35 U.S.C. 154(b) by 0 days.

(21) Appl. No.: 09/996,896

(22) Filed: Nov. 30, 2001

(51) Int. Cl.[7] ..... B65D 5/28

(52) U.S. Cl. ..... 229/198; 220/7; 220/692; 229/913

(58) Field of Search ..... 229/198, 198.1, 229/198.2, 198.3, 913; 220/6, 7, 692, 693; 312/348.1, 348.2

(56) References Cited

U.S. PATENT DOCUMENTS 964,396 A * 7/1910 Colle et al. ..... 229/198.1
1,486,513 A * 3/1924 Craig ..... 229/198.1
2,200,320 A * 5/1940 Zalkind ..... 229/913
3,759,600 A * 9/1973 MacDonald ..... 312/348.1
6,142,365 A * 11/2000 Breitbach ..... 229/198.2
6,155,444 A * 12/2000 Liu ..... 220/7

* cited by examiner

*Primary Examiner*—Gary E. Elkins

(57) ABSTRACT

An article-holding box comprises a bottom plate and a plurality of side plates. The bottom plate and the side plates form and define a space for holding articles such that two adjoining ends of the side plates are joined together by a corner structure. The corner structure comprises a first connection end of the side plates and a second connection end of the side plates. The second connection end is contiguous to the first connection end. Both connection ends are provided with retaining devices.

1 Claim, 10 Drawing Sheets

CORNER STRUCTURE OF ARTICLE-HOLDING BOX

BACKGROUND OF THE INVENTION

1. Field of the Invention

The present invention relates generally to an article-holding box, and more particularly to a corner structure of the article-holding box.

2. Description of Related Art

As shown in FIG. 1, a prior art corner structure of the article-holding box comprises one end of a side plate 10, one end of another side plate 11, a folded edge 12 of the one end of the side plate 10, a lashing member 13, and a plurality of rivets 14. The two adjoining ends of the two side plates 10 and 11 are held together by the lashing piece 13 in conjunction with the rivets 14. In general, the article-holding box has four corners. In light of the structural complexity of the prior art corner structure, the prior art article-holding box is not cost-effective at best.

BRIEF SUMMARY OF THE INVENTION

The primary objective of the present invention is to provide an article-holding box with four corner structures which are simple in construction and are cost-effective.

In keeping with the principle of the present invention, the foregoing objective of the present invention is attained by a corner structure comprising two adjoining ends of two side plates of the box. The adjoining ends are provided with means to fasten together the two adjoining ends.

The features and the advantages of the present invention will be readily understood upon a thoughtful deliberation of the following detailed description of the present invention with reference to the accompanying drawings.

DETAILED DESCRIPTION OF THE INVENTION

Figure 10:
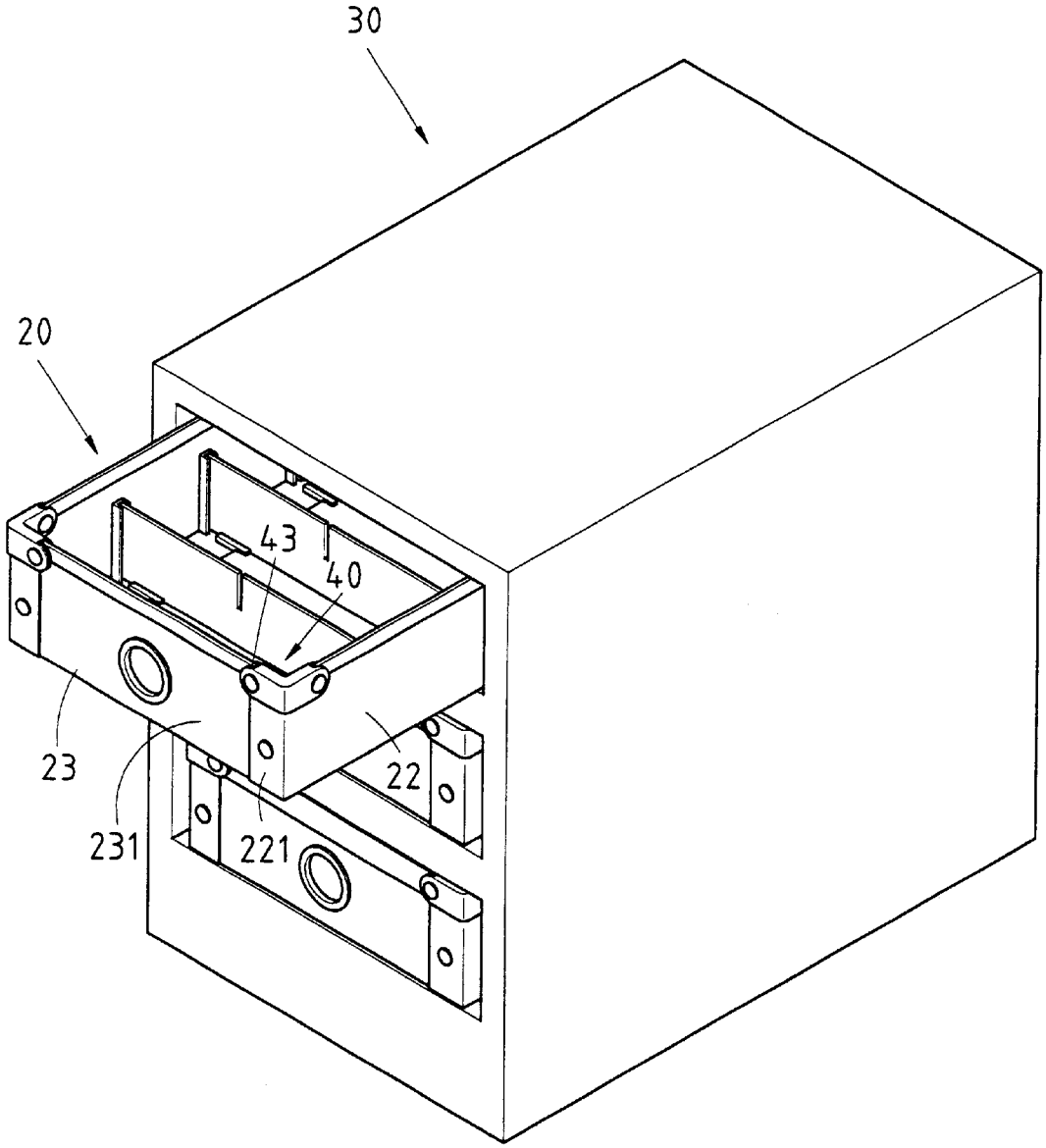
FIG. 10 shows a schematic view of the present invention in use.

As shown in FIGS. 2–10, an article-holding box 20 of the present invention is formed of two long side plates 22, two short side plates 23, and a bottom plate 21. These plates form and define a space for holding various articles. The space is compartmentalized by means of partitions 24 and 25. The boxes 20 of the present invention may be used as parts of a cabinet 30, as shown in FIG. 10.

The box 20 of the present invention has four corners, each having a corner structure 40. In other words, two adjoining ends of the side plates are joined together by the corner structure 40, which is the feature of the present invention.

Figure 1:
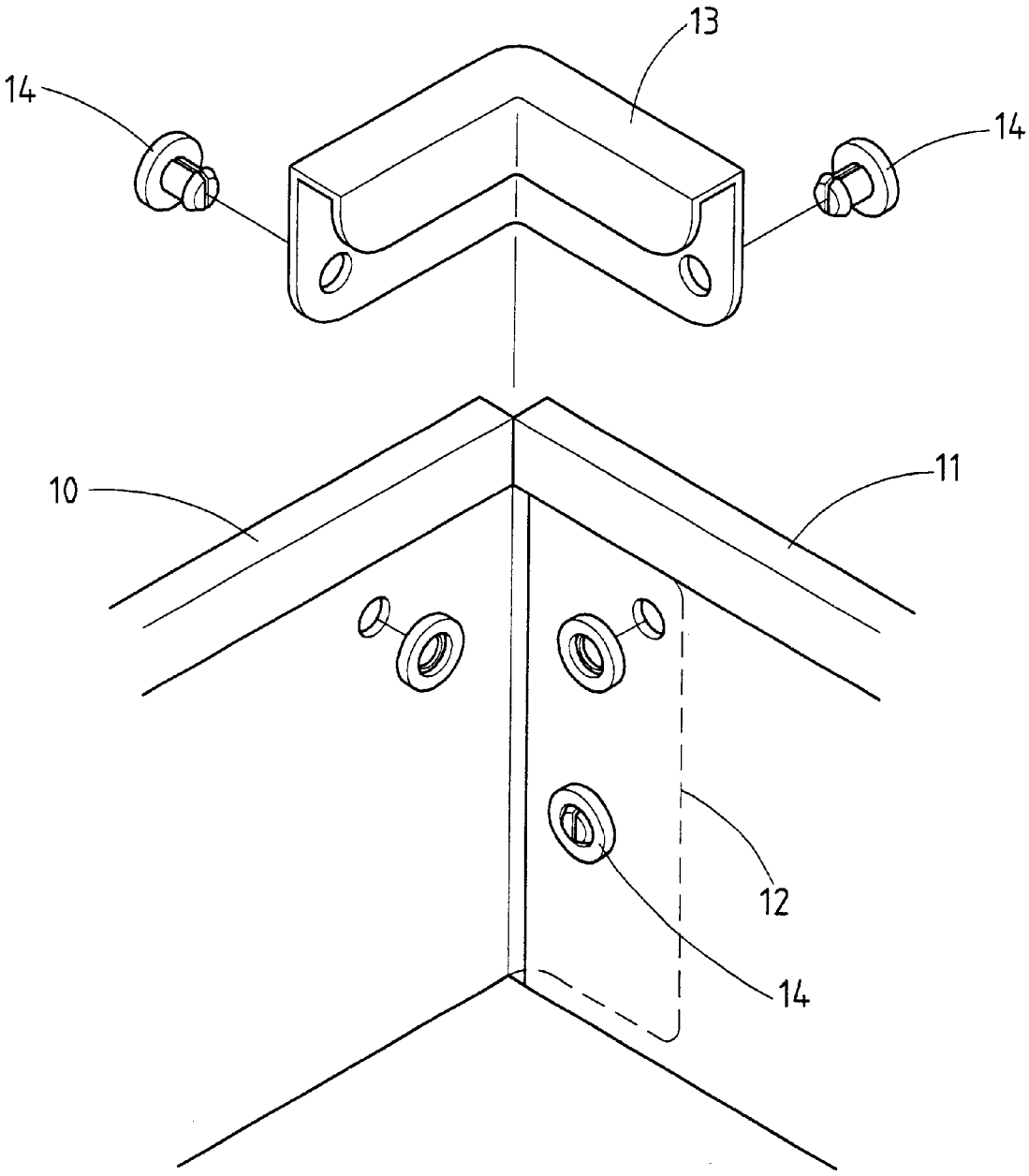
FIG.1 PRIOR ART
FIG. 1 shows an exploded view of a box corner structure of the prior art.
Figure 2:
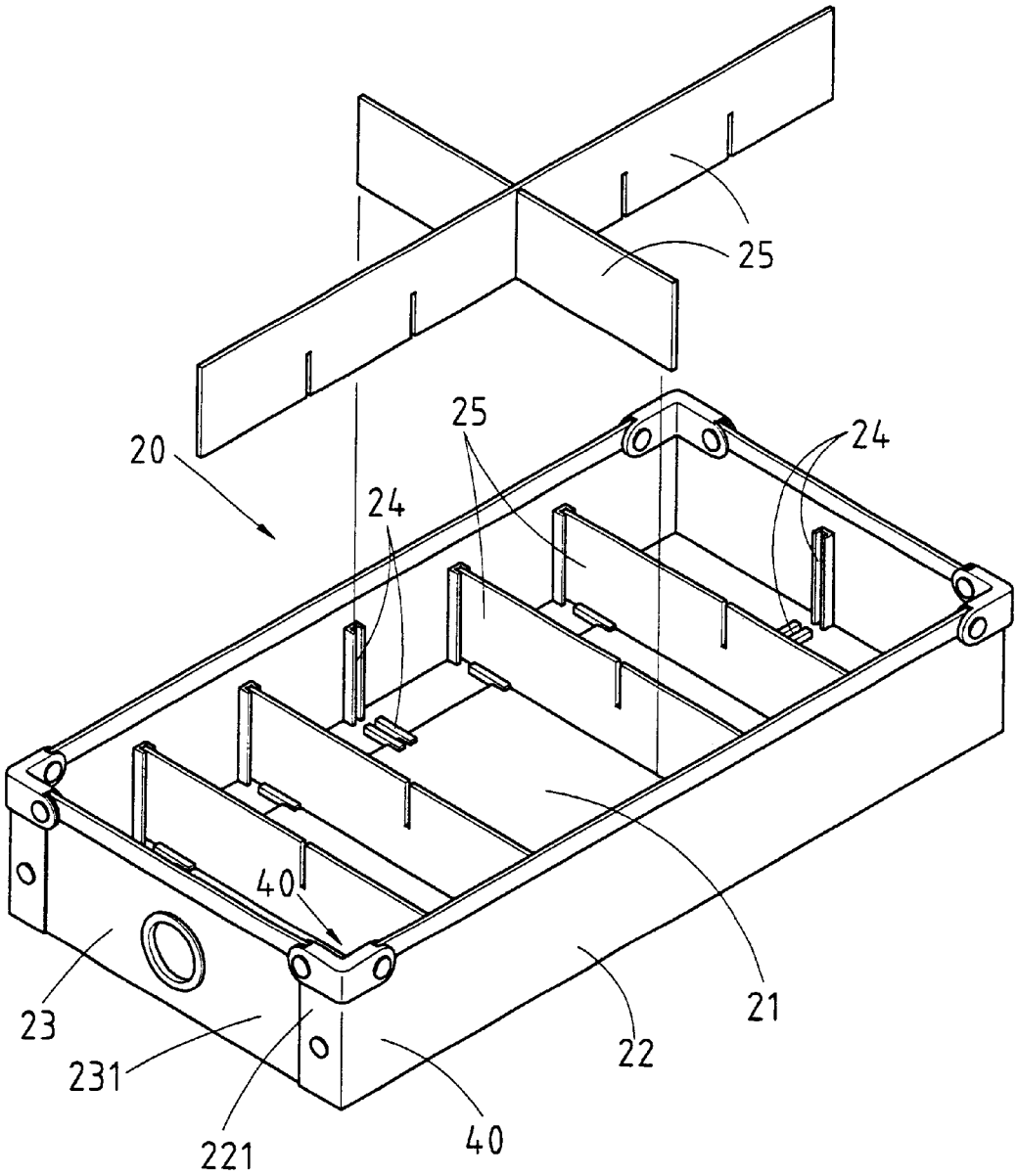
FIG. 2 shows a perspective view of an article-holding box of the present invention.
Figure 3:
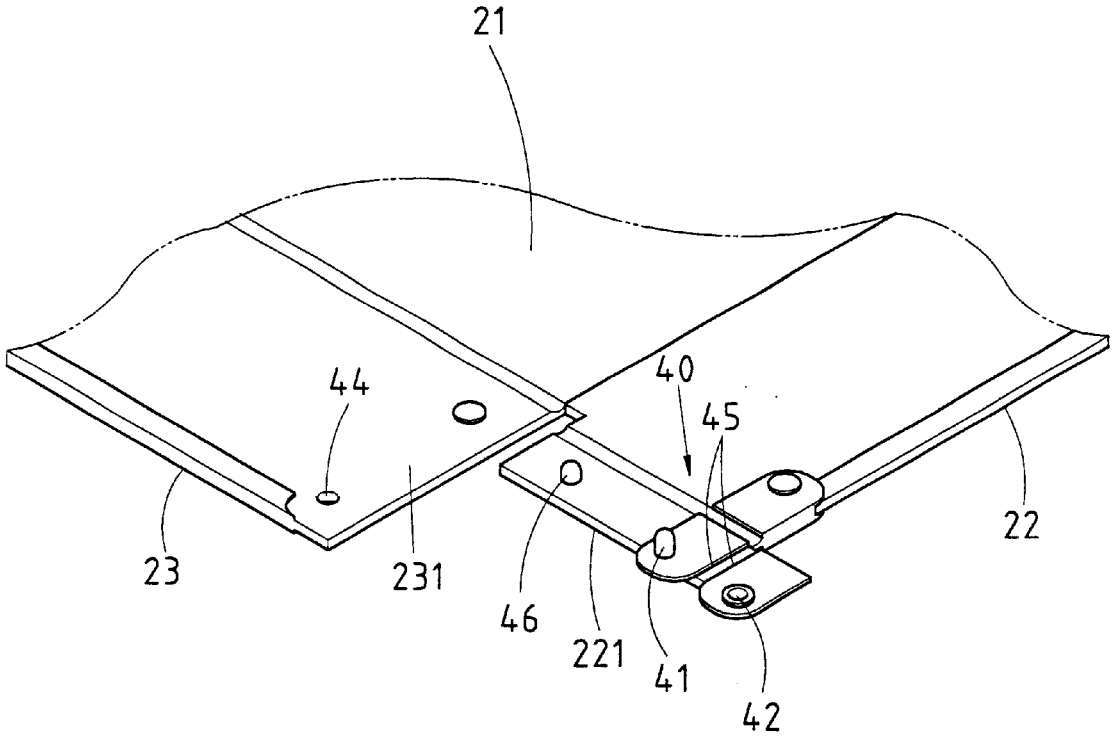
FIG. 3 shows a schematic view of a box corner structure of the present invention.
Figure 4:
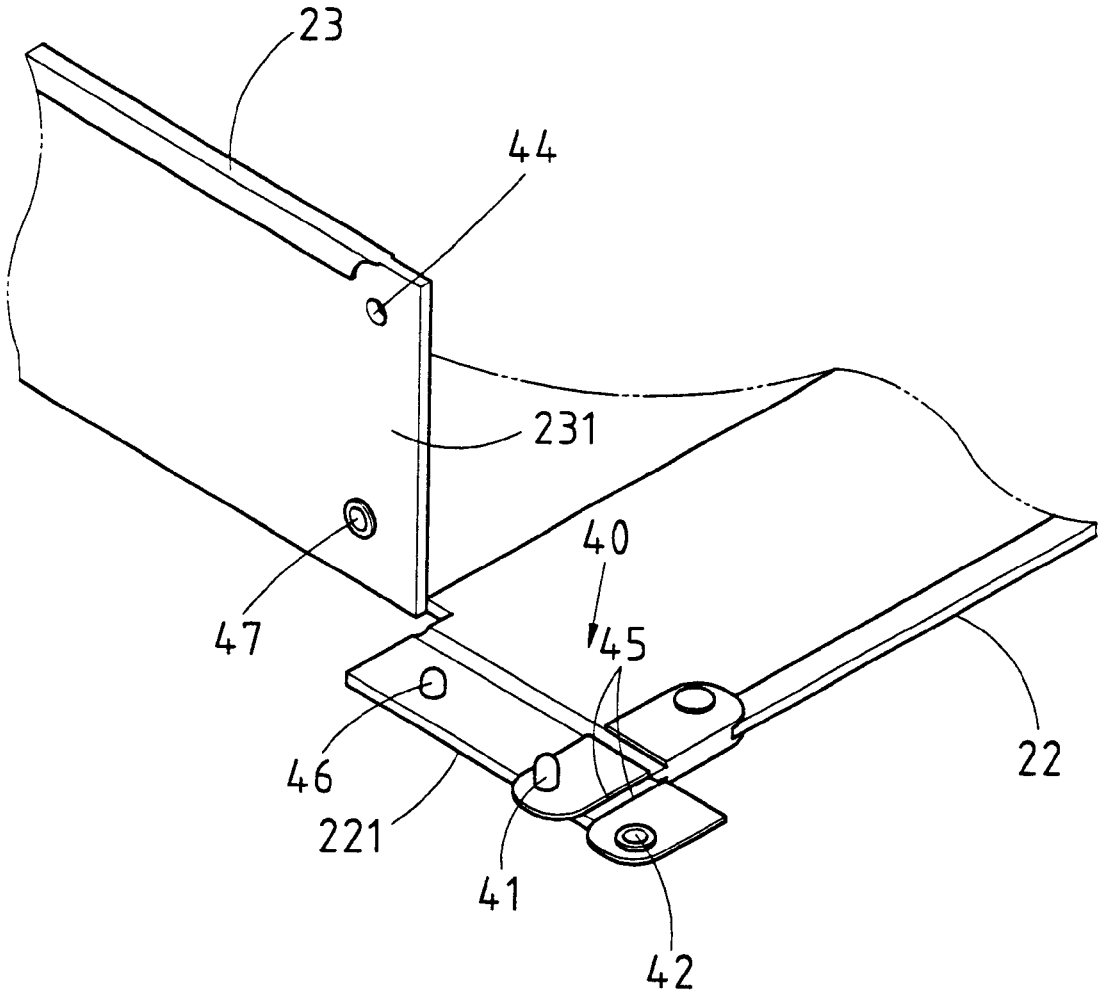
FIGS. 4–6 are schematic views of the assembly of the box corner structure of the present invention.
Figure 5:
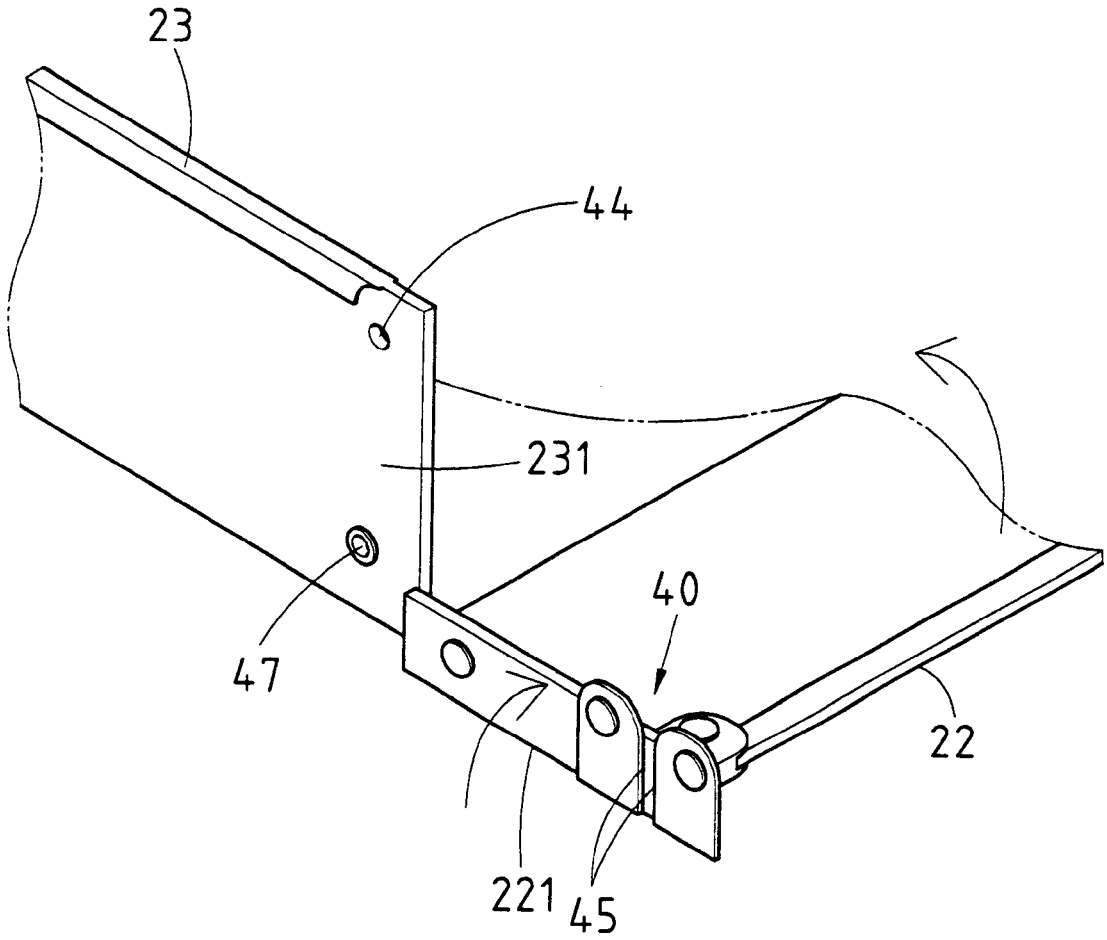
Figure 6:
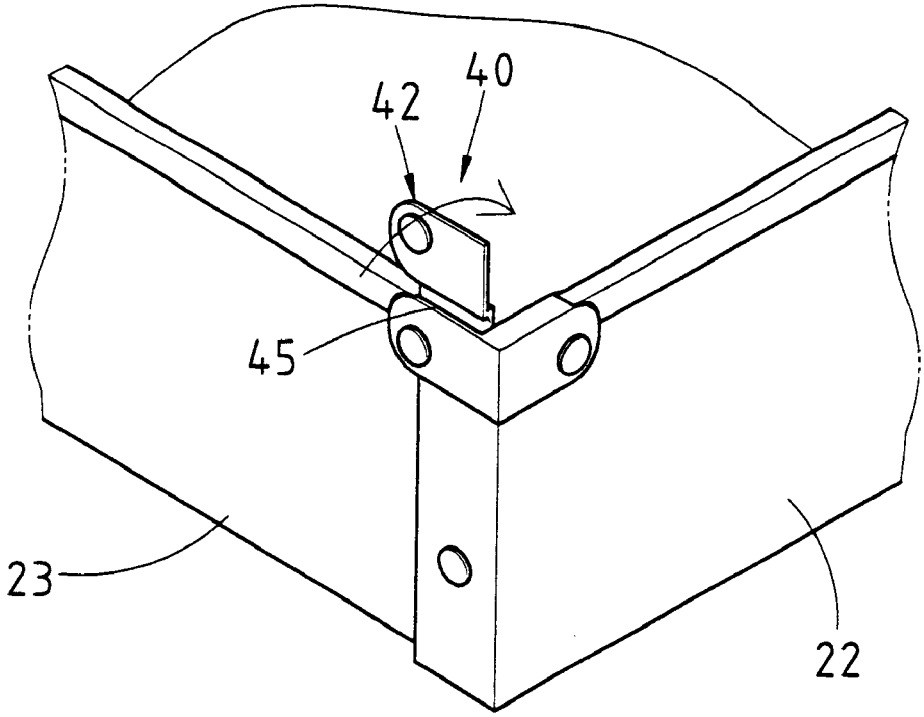
Figure 7:
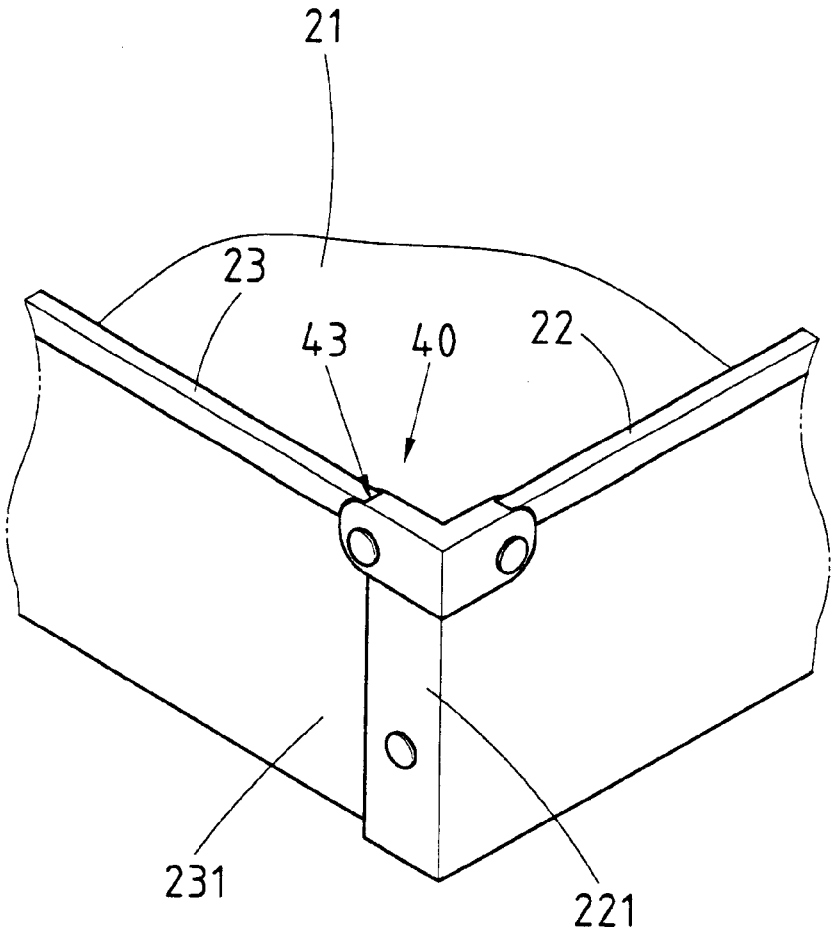
FIG. 7 shows a perspective view of the box corner structure of the present invention in combination.
Figure 8:
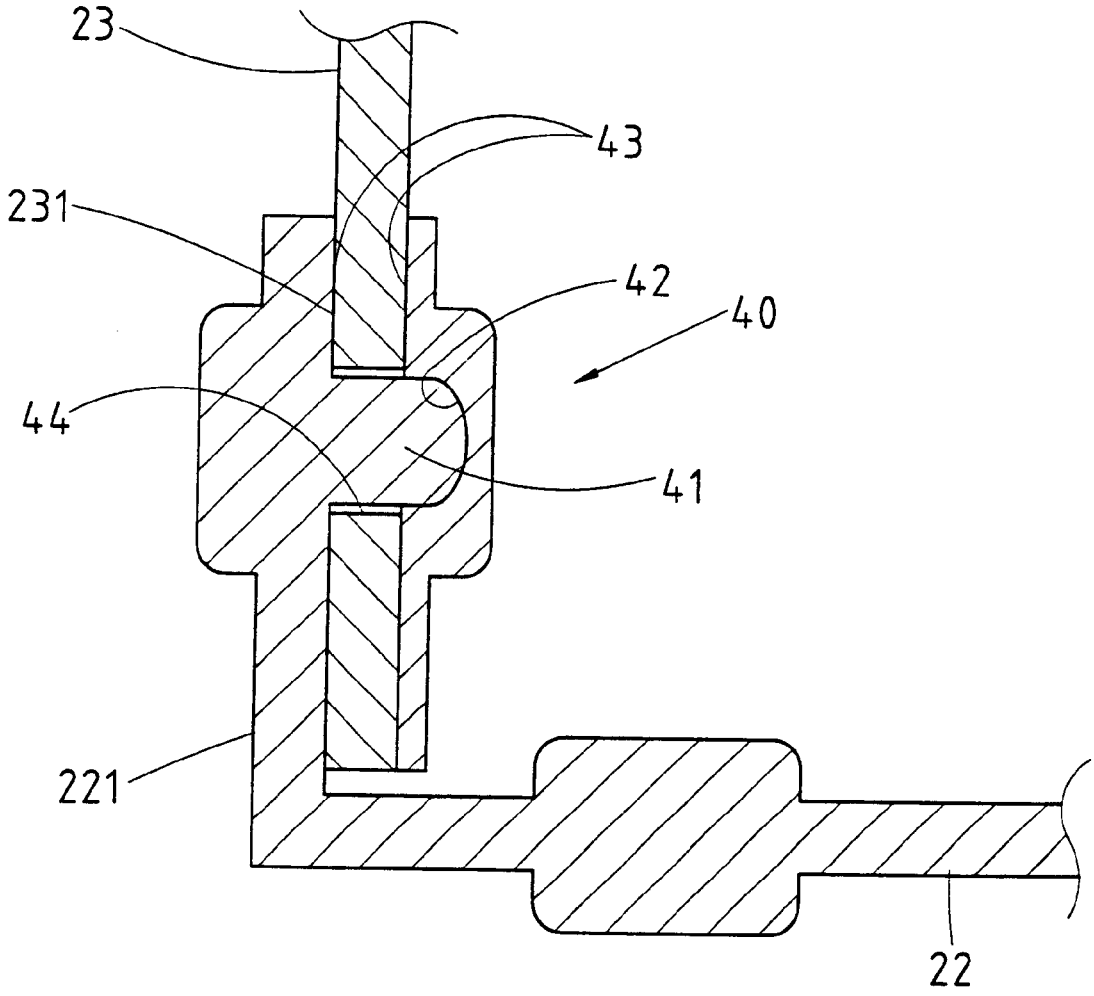
FIG. 8 shows a longitudinal sectional view of the box corner structure as shown in FIG. 7.
Figure 9:
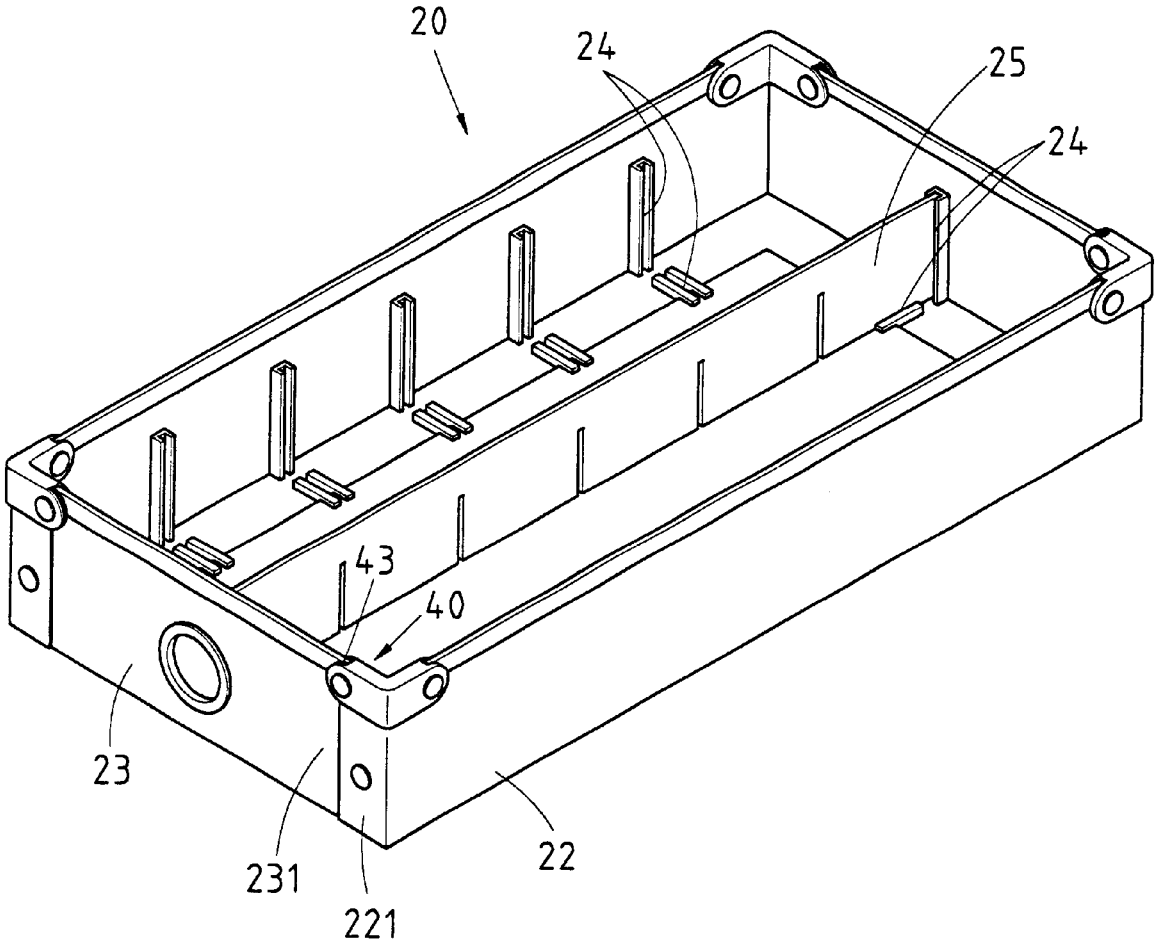
FIG. 9 shows a schematic view of the article-holding space of the article-holding box of the present invention.

As shown in FIGS. 3–8, the corner structure 40 comprises a first connection end 221 of one long side plate 22 and a second connection end 231 of one short side plate 23. The second connection end 231 is provided with a through hole 44 and a retaining slot 47. The first connection end 221 is provided with a retaining projection 41, a retaining slot 42, a folding portion 45 located between the retaining projection 41 and the retaining slot 42, and a retaining pillar 46. In combination, the first connection end 221 is joined with the second connection end 231 such that the retaining projection 41 of the first connection end 221 is retained in the retaining slot 42 of the first connection end 221 via the through hole 44 of the second connection end 231, and that the retaining pillar 46 of the first connection end 221 is retained in the retaining slot 47 of the second connection end 231. As illustrated in FIGS. 5, 6, and 7, the corner structure 40 of the present invention is of a flaplike construction.

The present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. An article-holding box comprising:

a bottom plate; and a plurality of side plates fastened uprightly with an upper surface of said bottom plate such that said side plates and said bottom plate form and define a space for holding one or more articles, and that two adjoining ends of said side plates are held together by a corner structure;

wherein said corner structure comprises:

a first connection end of said side plates and provided with one or more retaining projections arranged in a row, one or more retaining slots arranged in a row, and a folding portion located between said retaining slots and said retaining projections, said first connection end further provided with one or more retaining pillars; and a second connection end of said side plates, said second connection end being contiguous to said first connection end and being provided with one or more through holes and retaining slots, said through holes being corresponding in location and number to said retaining projections of said first connection end, said retaining slots of said second connection end being corresponding in location and number to said retaining pillars of said first connection end whereby said second connection end is joined with said first connection end in such a manner that said retaining projections of said first connection end are retained in said retaining slots of said first connection end via said through holes of said second connection end, and that said retaining pillars of said first connection end are retained in said retaining slots of said second connection end.

* * * * *